US008707840B2

(12) United States Patent
Weber

(10) Patent No.: US 8,707,840 B2
(45) Date of Patent: Apr. 29, 2014

(54) APPARATUS FOR SLICING FOOD PRODUCTS

(75) Inventor: Gürther Weber, Groβ Nemerow (DE)

(73) Assignee: Weber Maschinenbau GmbH Breidenbach, Breidenbach (DE)

( * ) Notice: Subject to any disclaimer, the term of this patent is extended or adjusted under 35 U.S.C. 154(b) by 468 days.

(21) Appl. No.: 13/079,095

(22) Filed: Apr. 4, 2011

(65) Prior Publication Data

US 2011/0247469 A1 Oct. 13, 2011

(30) Foreign Application Priority Data

Apr. 7, 2010 (DE) ..... 10 2010 013 891

(51) Int. Cl.

| | |
|---|---|
| ***B26D 5/02*** | (2006.01) |
| ***B26D 5/06*** | (2006.01) |
| ***B26D 7/26*** | (2006.01) |
| ***B26D 1/157*** | (2006.01) |

(52) U.S. Cl.
USPC ..... 83/508.2; 83/676; 83/932

(58) Field of Classification Search
USPC ..... 83/502, 508.2, 676, 932
See application file for complete search history.

(56) References Cited

U.S. PATENT DOCUMENTS

| | | | | |
|---|---|---|---|---|
| 3,828,633 | A * | 8/1974 | Klingen | 83/56 |
| 2007/0119285 | A1* | 5/2007 | Weber et al. | 83/663 |
| 2007/0237589 | A1* | 10/2007 | Mueller | 408/16 |
| 2010/0192745 | A1* | 8/2010 | Weber | 83/508.2 |

FOREIGN PATENT DOCUMENTS

| | | | |
|---|---|---|---|
| DE | 154952 | 1/1904 | |
| DE | 186288 | 11/1905 | |
| DE | 4214264 | 11/1993 | B26D 1/20 |
| DE | 10147348 | 1/2003 | B26D 7/26 |
| DE | 10333661 | 2/2005 | B26D 1/157 |
| DE | 10359149 | 7/2005 | B26D 5/02 |
| DE | 102006043697 | 3/2008 | B26D 1/157 |
| DE | 102008024361 | 11/2009 | B26D 7/26 |
| EP | 0289765 | 3/1988 | B26D 1/14 |
| EP | 1046479 | 4/2000 | B26D 5/02 |
| WO | WO 03/028963 A1 | 4/2003 | |

OTHER PUBLICATIONS

European Search Report for Corresponding European Application EP11002380.1 dated Jun. 29, 2011; 3 Pages.
Translation of European Search Report for Corresponding European Application EP11002380.1 dated Jun. 29, 2011; 4 Pages.
European Search Report for Corresponding European Application EP11002380 dated Jun. 29, 2011; 3 Pages.

* cited by examiner

*Primary Examiner* — Stephen Choi

(57) ABSTRACT

An apparatus for slicing food products includes a product feed, at least one cutting blade which rotates about a blade axis and/or revolves about a center axis and to which at least one product to be sliced can be fed in a product feed direction and a blade holder to which the cutting blade can be attached. An adjustment device is configured to deform the cutting blade.

18 Claims, 2 Drawing Sheets

APPARATUS FOR SLICING FOOD PRODUCTS

Figure 1:
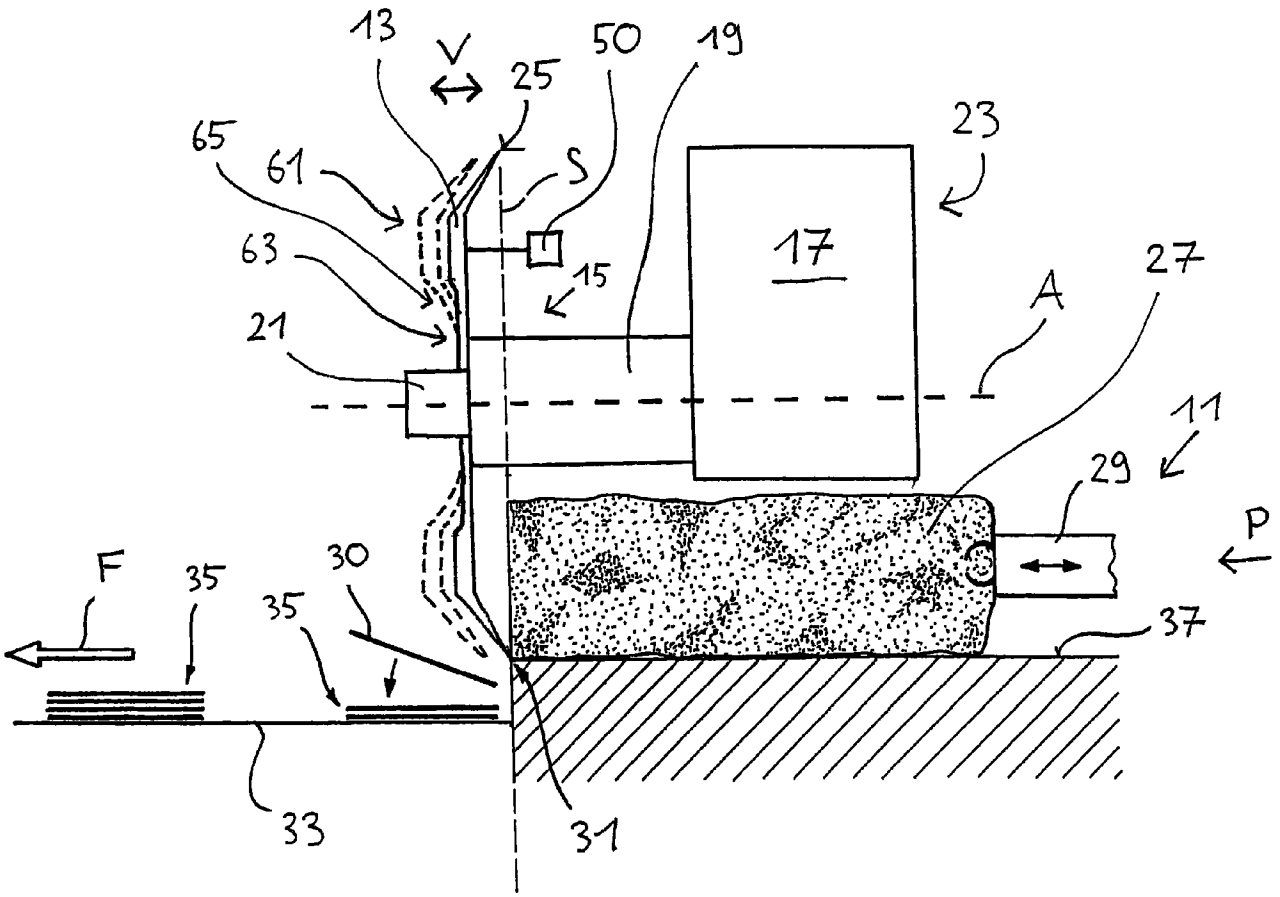

The present invention relates to an apparatus for slicing food products, in particular to a high-performance slicer, having a product supply device, at least one cutting blade which rotates about a blade axis and/or revolves about a center axis and to which at least one product to be sliced can be supplied in a product supply direction and having a blade holder to which the cutting blade can be attached.

Such apparatus are generally known and serve to cut food products such as sausage, meat and cheese into slices at high speed. Typical cutting speeds lie between several 100 to some 1,000 cuts per minute. Modern high-performance slicers differ inter alia in the design of the cutting blade as well as in the manner of the rotary drive for the cutting blade. So-called scythe-like blades or spiral blades rotate about an axis of rotation, here also called a blade axis, wherein this axis of rotation itself does not carry out any additional movement, with this, however, not being compulsory, i.e. alternatively, the axis of rotation can itself carry out and additional movement of any kind. Provision is, in contrast, made with circular blades to allow the rotating circular blade additionally to revolve in a planetary motion about a further axis (here also called a center axis) spaced apart from the axis of rotation. Which blade type or which type of drive is to be preferred depends on the respective application. It can generally be stated that higher cutting speeds can be achieved with only rotating scythe-like blades, whereas rotating circular blades and circular blades additionally revolving in a planetary motion can be used more universally without compromises in the cutting quality.

The above-mentioned high cutting speeds make it necessary—and this applies independently of the type of blade and of the type of drive—that, in particular with a portion-wise slicing of products, so-called blank cuts are carried out in which the blade continues to move, i.e. carries out its cutting movement, but does not cut into the product in so doing, but rather cuts into space so that temporarily no slices are cut off from the product and these "cutting breaks" can be used to transport away a portion formed with the previously cut off slices, for example a slice stack or slices arranged overlapping. The time elapsing between two slices cut off after one another is not sufficient for a proper transporting away of the slice portions from a specific cutting performance or cutting speed onward. The length of these "cutting breaks" and the number of blank cuts per "cutting break" are dependent on the respective application.

A problem known in practice in connection with the carrying out of blank cuts is that it is not sufficient in most cases simply to stop the feed of the product temporarily to prevent the cutting off of slices. With products having a soft consistency, it namely regularly occurs that after the stopping of the product feed, relaxation effects come into force, whereby the front product end moves beyond the cutting plane and thus enters into the active zone of the cutting blade. The consequence is an unwanted cutting off of so-called product snippets or product scraps. Apart from this, such a scrap formation always necessarily occurs independently of the product consistency whenever the products are continuously supplied during the slicing operation, i.e. even with products of a solid consistency in which therefore the above-mentioned relaxation effects do not occur, there is scrap formation with a continuous product feed.

The above-described phenomena are sufficiently known to the skilled person so that they will not be looked at in more detail.

Measures are already known from the prior art, which serve to avoid scrap formation on the carrying out of blank cuts. Reference is made for this purpose, for example to EP 0 289 765 A1, DE 42 14 264 A1, EP 1 046 476 A2, DE 101 147 348 A1, DE 154 952, DE 10 2006 043 697 A1 and DE 103 33 661 A1.

It has accordingly already been proposed not only to interrupt the product feed for the carrying out of blank cuts, but additionally to retract the product—if necessary together with the product support. This approach in particular reaches its limits when the cutting speeds and/or the masses to be moved in this process become too large since it can then no longer be ensured that the front product end can be retracted sufficiently fast. It has furthermore already been proposed as an alternative to the retraction of the product to move the cutting blade away from the front product end. Both solution approaches have the consequence that a sufficiently large spacing is established between the front product end and the cutting blade which reliably prevents scrap formation. The required blade stroke only amounts to some millimeters; however, it must take place in a very short time in the order of some hundredths of seconds. The possibility of a blade adjustment can also be utilized for further additional functions, e.g. for the setting of the cutting gap or for blank cuts within the framework of a vertical adjustment or an adjustment of the dipping depth of the cutting blade which in particular takes place with respect to the product or products to be sliced or with respect to the product support, which will be looked at in more detail in the following.

The prior art proposes various possibilities of establishing the desired spacing between the blade and product by a transposition of the blade.

One possibility, which is described, for example, in DE 101 47 348 A1, comprises only moving the rotating blade holder to which the blade is replaceably attached and which is also called a blade mount, blade shaft or rotor, and indeed relative to the other components of the so-called blade head which in particular includes, in addition to the mentioned blade holder, a rotary bearing for the rotational movement of the blade or of the blade holder as well as a base part with which the blade head and thus the blade holder is fastened to a rack or frame of the slicer. This fastening can take place, for example, at or in a so-called cutting head housing to which or in which not only the blade head together with the blade is attached, but also the drive motor for the rotary blade drive cooperating with the blade head e.g. via a drive belt It is also possible to displace the blade head as a whole so that a relative movement between the blade holder and the rotary bearing of the blade is not required. Such a solution is shown, for example in DE 10 2006 043 697 A1.

It is furthermore possible to move the whole cutting head housing together with the blade head and the rotary drive. Solutions of this kind are described, for example, in EP 1 046 476 A2.

These solution approaches explained above do not only differ with respect to the size of the mass to be moved, but also with respect to the construction effort as well as with respect to the applicability for different blade kinds or drive kinds. A movement of only the blade holder, for example, admittedly has the advantage of a relatively small mass to be moved, but does mean a relatively high construction effort since with the blade an object has to be displaced along an axis or moved in a different manner, said object simultaneously rotating at a high speed, e.g. about precisely the named axis. Problems in connection with the journalling of the blade or of the blade holder have to be solved for this purpose. Whereas the above-mentioned scythe-like blades or spiral blades only rotate about one axis, but this axis does not additionally carry out a revolutionary movement, concepts for the adjustment of the blade can be realized with a justifiable effort despite the mentioned journalling problems. This is different with slicers having rotating circular blades which simultaneously revolves in the manner of a planet since there is the problem here of effecting a transposition of only the blade or of the blade holder with a justifiable construction effort.

Independently of the construction problems with respect to the journalling of the blade or of the blade holder, in the known solution approaches, the achievable adjustment speed can be too low due to the masses to be moved in order to carry out blank cuts without quality losses at high cutting speeds.

It is therefore the object of the invention to improve the performance capability in a cutting apparatus of the above-named kind with respect to a blade adjustment intended for providing additional functions and in particular to enable a more reliable carrying out of blank cuts.

This object is satisfied by the features of claim 1.

In accordance with the invention, an adjustment device is provided which is configured to deform the cutting blade. Instead of moving the whole cutting blade including the blade holder and/or a blade head relative to the product, only the shape of the cutting blade is therefore changed. Due to the deformation, the cutting range of the cutting blade can be retracted or moved away from the product for the carrying out of additional functions such as blank cuts without relatively heavy components having to be set into motion. Since therefore the mass to be accelerated on the adjustment is reduced, the adjustment of the blade can take place particularly fast. The deformation can, where required, be brought about by the adjustment device and can likewise be cancelled again, as required. Due to this principle, according to which the adjustment of the cutting blade takes place by a deformation thereof, the construction problems in connection with the rotational journalling of the blade holder are also removed since neither the blade holder nor the corresponding bearing components are involved in the adjustment movement.

The term "blade holder" is generally to be interpreted widely here. It is a component or an assembly at which the cutting blade is held directly or indirectly in a manner of any kind.

Advantageous embodiments of the invention are also set forth in the dependent claims, in the description and in the drawing.

It is generally possible in accordance with the invention, but not compulsory, to deform the cutting blade so that the desired adjustment is adopted over the total circumference of the cutting blade at all times. A deformation can namely also take place in accordance with the invention such that the desired adjustment is only adopted over a partial circumferential region of the cutting blade, e.g. only a part region of the blade edge is moved away from the product. In this concept, e.g. for the purpose of a reliable avoidance of a formation of scraps, the partial deformation of the cutting blade can be adapted to its speed of rotation and/or revolution, i.e. for example in the manner of the cyclic blade adjustment in the rotor of a helicopter, the cutting blade is always only regionally deformed during the adjustment operation, that is outside the normal cutting operation. In each case precisely that peripheral region of the still rotating and/or revolving cutting blade is in particular deformed which would cut into the product without deformation.

The cutting blade is preferably deformable such that a blade edge of the cutting blade and/or a section of the cutting blade including at least a blade edge of the cutting blade is movable with at least one component in an adjustment direction relative to the blade holder. The mass to be moved during the adjustment procedure can thereby be restricted to a minimum, which is advantageous with respect to a fast, precise and reliable adjustment. If, for example, blank cuts should be carried out, it is possible in accordance with the invention only to move a region otherwise coming into contact with the product just so far away from the product by deformation of the cutting blade that scrap formation is prevented.

The blade holder is preferably in a fixed position viewed in an adjustment direction. The blade holder can in particular be in a fixed position relative to a base frame of the apparatus viewed in an adjustment direction, e.g. relative to a slicer rack or to a slicer frame. Apart from the adjustment direction, the blade holder can naturally be movable, for example in accordance with a rotating and/or revolving drive of the cutting blade or in accordance with other setting or adjustment movements of the associated blade head or blade edge head. In such an embodiment, no separate adjustment apparatus has to be provided for the blade holder.

The adjustment device preferably extends parallel to the blade axis and/or to the center axis since this allows a particularly simple construction.

In accordance with an embodiment of the invention, the adjustment device is configured to move a section of the cutting blade radially outward with respect to the blade axis relative to a radially inner section fastened to the blade holder. The region close to the axis usually provided for fastening the cutting blade to the blade holder can therefore remain in a fixed position, whereas the blade edge region—with a knife holder immobile in the adjustment direction and a maintained fastening of the cutting blade at the blade holder—e.g. moves away from the front product end on the deformation.

The adjustment device can in particular be configured to engage at the cutting blade. The deformation can therefore take place by acting on the cutting blade itself. For this purpose, for example, drive pressure plungers or pressure rings can be provided. Contactless actions, e.g. by means of electromagnetic interaction, are also possible in accordance with the invention.

The cutting blade is preferably deformable in itself.

In accordance with an embodiment of the invention, the cutting blade has at least one bending region which is configured for deformation by the adjustment device due to its shape and/or property. The cutting blade is therefore designed in advance so that an easy and reliable deformability is present. The bending region can be formed in a simple manner by a tapering and/or by a reduced material thickness. A region of the cutting blade radially inward with respect to the blade axis could in particular be formed thinner than a radially outer region. Alternatively, the cutting blade could also be composed of sections of different properties, wherein a section of relatively soft material forms the bending region. The cutting blade can also generally be configured as flexible, i.e. the bending region can essentially extend over the total blade surface or extent of the blade.

The cutting blade is preferably configured at least regionally as elastically deformable and/or resilient. This is advantageous to the extent that the cutting blade can then move back automatically as soon as a deformation force is no longer exerted by the adjustment device. The adjustment device therefore does not have to exert any active force for the restoring movement in this embodiment.

The cutting blade can alternatively or additionally also include at least one elastically deformable and/or resilient element to allow or assist an automatic restoration. At least one leaf spring or plate spring can in particular be provided at the cutting blade, preferably at a radially inner section with respect to the blade axis.

In accordance with a further embodiment, the adjustment device has at least one adjustment member which is configured to exert a tensile force and/or compressive force onto the cutting blade to deform the cutting blade. The adjustment member can in particular be actuable electrically, hydraulically or pneumatically. Depending on the application, the adjustment member can act directly on the cutting blade or suitable transmission elements can be provided for transferring the adjustment force of the adjustment member to the cutting blade.

The adjustment member can include an element which is displaceable at the blade holder and which is in communication with the cutting blade via a coupling device. The force provided for the deformation can be transferred in a simple manner by means of the displaceable element and the coupling device from a drive element of the adjustment member to the cutting blade. For example, the displaceable element can be a sliding sleeve which is slidingly supported on a shaft section of the blade holder.

The coupling device can include at least one articulated lever, in particular a plurality of articulated levers arranged distributed in the peripheral direction at the displaceable element. The articulated levers can be attached in the manner of an umbrella to one end of the sliding sleeve and engage at the cutting blade at the other end. Optionally, the articulated levers can each include two or more mutually pivotable parts or can be configured changeable in length in a different manner.

To allow a blade deformation exactly coordinated in time, a control device can be provided which is configured to actuate the adjustment device as required during a cutting operation to carry out at least one additional function.

In accordance with a further embodiment of the invention, the blade holder is a component of a blade head which is in a fixed position viewed in the adjustment direction. Since the blade head is in a fixed position, a corresponding adjustment device for the blade head can be saved.

The blade head can be configured as a head of a scythe-like blade for a scythe-like blade rotating about the blade axis. Alternatively, the blade head can be configured as a circular blade head for a circular blade rotating about the blade axis and revolving about the center axis in the manner of a planet. The blade head can furthermore have at least one rotary drive associated with it which, together with the blade head, is arranged at or in a cutting head housing fixed to the rack. The rotary drive also does not necessarily have to be moved in accordance with the invention for the adjustment of the cutting blade since the adjustment movement is effected by the deformation of the cutting blade itself. If it is a case of a circular blade head, a single common drive can be provided for the rotation of the cutting blade, on the one hand, and for the revolution of the cutting blade, i.e. for the rotation about the center axis, on the other hand. It is, however, also possible to provide a distinct and/or separate drive, in particular mutually independent drives, for each of these movements.

In accordance with a further embodiment, the cutting blade is deformable such that there is a spacing change between the cutting blade and a reference plane which extends parallel to a cutting plane defined by the blade edge of the cutting blade located in a cutting position. That plane is e.g. to be understood as the reference plane in which the front end of the product to be sliced, that is the instantaneous cutting surface of the product, at least approximately lies during the cutting operation. The adjustment movement of the cutting blade provides a sufficiently large spacing between the cutting plane always defined by the blade edge of the cutting blade and the front product end, whereby scrap formation is prevented. The reference plane can also coincide with that plane in which the cutting plane lies when the cutting blade is in the cutting position. Even if the cutting blade is not located in the cutting position, that is between the start and end of the adjustment procedure, the reference plane can extend parallel to the cutting plane. This depends on the specific manner of the adjustment movement of the cutting blade.

The cutting blade is preferably deformable for carrying out at least one additional function, in particular for carrying out blank cuts and/or for setting a cutting gap.

The invention will be described in the following by way of example with reference to the drawing.

Figure 2:
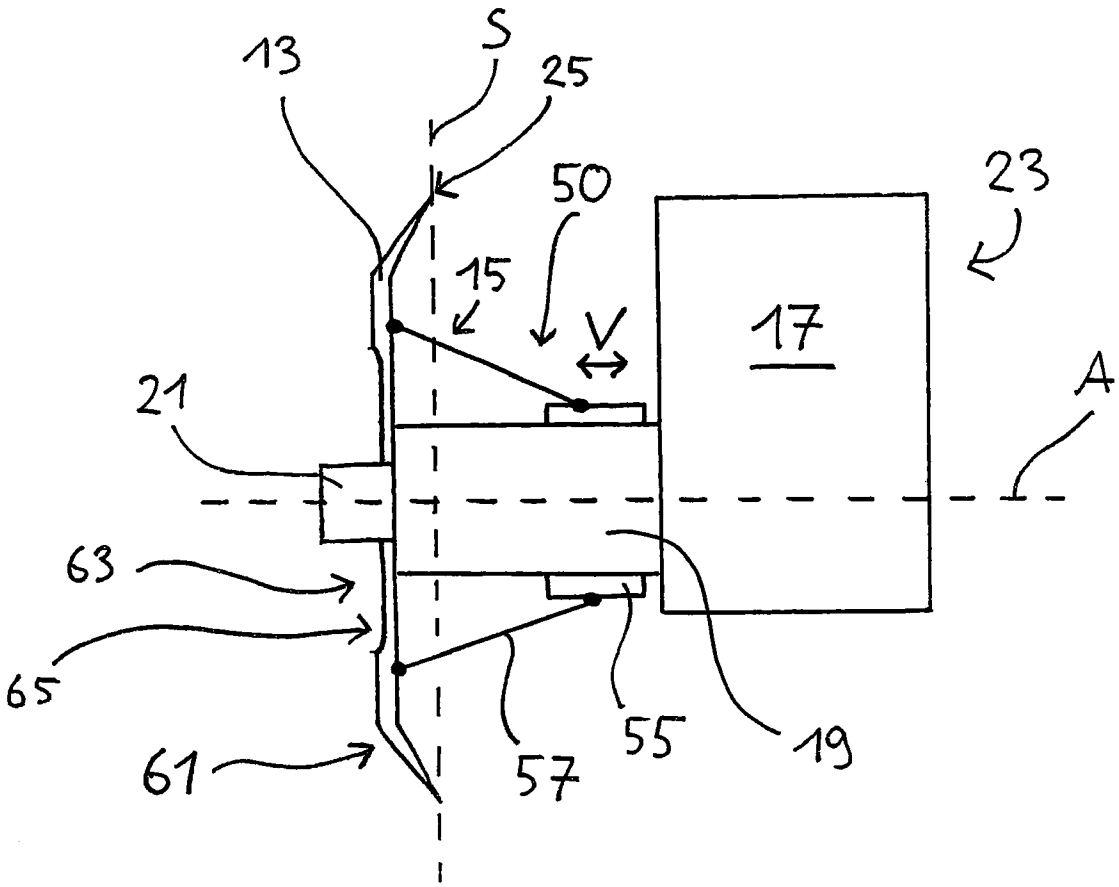

FIG. 1 shows a simplified representation of an apparatus in accordance with the invention for slicing food products; and FIG. 2 shows an example for an adjustment apparatus in accordance with FIG. 1.

In accordance with FIG. 1, a high-performance slicer includes a product feed 11, a cutting blade 13 as well as a blade holder 15 for the cutting blade 13. The cutting blade 13 is here configured as a scythe-like blade which rotates about a blade axis A. The blade holder 15 is rotatably supported in a bearing 1 and includes a base section 19 as well as a plug section 21. The cutting blade 13 is plugged onto the plug section 21 of the blade holder 15 and is fastened to an end face of the base section 19 by means of screws which are not shown. A rotary drive, not shown, serves to set the blade holder 15 into a rotary movement about the blade axis A by means of a drive belt. The blade holder 15 together with the bearing 17 forms a blade head 23 which is attached together with the rotary drive in a fixed position in a cutting head housing, not shown, of the slicer.

A blade edge 25 of the cutting blade 13 always defines a cutting plane S extending at right angles to the blade axis A independently of the operating state of the cutting blade 13. A product bar 27 is located on a product support 37 of the product feed 11 and rear end holding claws 29 engage at its rear end are movable by a controlled drive, not shown, in and against a product feed direction P, which is shown by a double arrow in FIG. 1. The product bar 27 is fed along the product feed direction P of the cutting plane S by means of the driven holding claws 29. Instead of as single product bar 27, a plurality of product bars arranged next to one another can be fed to the cutting plane S together.

During the operation of the high-performance slicer, the rotating cutting blade 13 cuts through the product bar 27 with its blade edge 25 and cuts product slices 30 from said product bar, with it cooperating with a cutting edge 31 forming the end of the product support 37. The coincidence of the cutting plane S with a plane defined by the cutting edge 31 is lost to a simplified representation here. In practice, a small, usually adjustable cutting gap is present between the cutting blade 13 and the cutting edge 31, which does not however, have to be looked at in any more detail here. The feed speed of the product bar 27 and thus the thickness of the product slices 30 is in this respect adjustable by a corresponding control of the driven holding claws 29. The cut-off product slices 30 fall on the rear blade side remote from the product feed 11 onto a support 33 and can be conveyed further or processed further along a conveying direction F and can in particular be fed to an automatic packaging plant (not shown).

It can be seen from FIG. 1 that the slicing of the product bar 27 takes place portion-wise, i.e. the cut-off product slices 30 form portions 35 which are here shown as slice stacks. As soon as a portion 35 is complete, this portion 35 is transported off in the conveying direction F on the support 33. So that sufficient time is available for the transporting away of the finished portions 35, the above-mentioned blank cuts are carried out until the start of the formation of the next portion 35, for which purpose, on the one hand, the product supply also called a product feed—that is here the holding claws 29—is stopped and optionally retracted and, on the other hand, the cutting blade 13 is deformed so that it adopts the position shown by dashed lines in FIG. 1. In this position, the blade edge 25 of the cutting blade 13 is spaced apart from the front end of the product bar 27 so that a scrap formation or snippet formation during the carrying out of blank cuts is reliably avoided. To bring about the deformation of the cutting blade 13, an adjustment device 50 controlled by a control device, not shown, is provided which is only shown schematically in FIG. 1.

On the deformation of the cutting blade 13, as can be seen from FIG. 1, a section 61 of the cutting blade 13 radially outward with respect to the blade axis A is moved will respect to a radially inner section 63. In the region of the radial inner section 63, the cutting blade 13 is fastened to the blade holder 15 so that the radially inner section 63 is held fast at least at the fastening points during the deformation process. This therefore means that the cutting blade 13 is curved by a specific amount on activation of the adjustment device 50 so that the blade edge 25 carries out a movement which has a component in the adjustment direction V.

To ensure a sufficient deformability of the cutting blade 13, it is made from an elastic material. The radially inner section 63 is furthermore tapered with respect to the radially outer section 61, i.e. the cutting blade 13 has a reduced material thickness in the region of the radially inner section 63. The radially inner section 63 thereby forms a bending region which is provided for deformation whereas the radially outer section 61 is relatively stiff. To assist the elasticity, at least one additional spring element can be provided, which is, however, not shown in FIG. 1. When a carried out additional function is to be stopped, the adjustment device 50 stops the exertion of force onto the cutting blade 13 and the cutting blade 13 automatically again adopts the starting position (cutting position) shown in solid lines in FIG. 1 due to its elastic configuration.

FIG. 2 shows an embodiment of the adjustment apparatus 50 in more detail. For simplification, the product bar, the product feed and the product support have been omitted in the representation of the slicer in accordance with FIG. 2. The adjustment device 50 includes a sliding sleeve 55 which is provided on the base section 19 of the blade holder 15 and which can be moved to and fro by a setting drive, not shown, along the adjustment direction V. Articulated levers 57 which are pivotally connected to the cutting blade 13 at their end remote from the sliding sleeve 55 are pivotally connected, arranged distributed in the peripheral direction, to the outer surface of the sliding sleeve 55. To provide a changeability of length of the articulated levers 57, they can be composed of at least two mutually pivotable parts, which is not shown in detail in FIG. 2. On a movement of the sliding sleeve 55, the articulated levers 57 exert a tensile or compressive force in the adjustment direction V onto the radially outer section 61 of the cutting blade 13 and thus bend the cutting blade 13 into one of the two positions shown in FIG. 1.

Instead of the arrangement of sliding sleeve 55 and articulated levers 57, different alternative transfer mediums are possible such as pneumatically actuated pressure plungers or pressure rings, hydraulic solutions or electric or electromagnetic arrangements.

Due to the principle of the blade deformation, practically only the radially outer section 61 of the cutting blade 13 has to be set into motion for carrying out additional functions with the slicer, whereas all other components of the slicer remain in fixed position with respect to the adjustment movement. The mass to be moved for a desired adjustment of the cutting blade 13 is thus reduced to a particularly low value.

| Reference numeral list | |
|---|---|
| 11 | product feed |
| 13 | cutting blade |
| 15 | blade holder |
| 17 | bearing |
| 19 | base section |
| 21 | plug section |
| 23 | blade head |
| 25 | blade edge |
| 27 | product bar |
| 29 | holding claws |
| 30 | product slice |
| 31 | cutting edge |
| 33 | support |
| 35 | portion |
| 37 | product support |
| 50 | adjustment device |
| 55 | sliding sleeve |
| 57 | articulated lever |
| 61 | radially outer section |
| 63 | radially inner section |
| 65 | bending region |
| A | blade axis |
| S | cutting plane |
| P | product feed direction |
| F | conveying direction |
| V | adjustment direction |

The invention claimed is:

1. An apparatus for slicing food products (27), comprising a product feed (11);

at least one cutting blade (13) that includes a blade edge (25) and that rotates about a blade axis (A) and/or revolves about a center axis and to which at least one product (27) to be sliced is fed in a product feed direction (P); and a blade holder (15) to which the cutting blade (13) is attached, wherein an adjustment device (50) is provided which is configured to deform the cutting blade (13), a first plane is defined by the blade edge (25) of the cutting blade (13) when the cutting blade (13) is not deformed, a second plane is defined by the blade edge (25) of the cutting blade (13) when the cutting blade is deformed, and the second plane is spaced from and parallel to the first plane.

2. An apparatus in accordance with claim 1, wherein the cutting blade (13) is deformable such that the blade edge (25) of the cutting blade (13) and/or a section of the cutting blade (13) including at least one blade edge (25) of the cutting blade (23) is movable in an adjustment direction (V) relative to the blade holder (15).

3. An apparatus in accordance with claim 1, wherein the adjustment device (50) is configured to move a section (61) of the cutting blade (13) radially outward with respect to the blade axis (A) relative to a radially inner section (63) fastened to the blade holder (15).

4. An apparatus in accordance with claim 1, wherein the adjustment device (50) is configured to engage at the cutting blade (13).

5. An apparatus in accordance with claim 1,
wherein
the cutting blade (13) has at least one bending region (65) which is configured for deformation by the adjustment device (50) due to a shape and/or property of the at least one bending region (65).

6. An apparatus in accordance with claim 5,
wherein
the bending region (65) is formed by a taper and/or a reduced material thickness.

7. An apparatus in accordance with claim 1,
wherein
the cutting blade (13) is configured at least regionally as elastically deformable and/or resilient.

8. An apparatus in accordance with claim 1,
wherein
the cutting blade (13) includes at least one elastically deformable and/or resilient element.

9. An apparatus in accordance with claim 1,
wherein
the adjustment device (50) has at least one adjustment member which is configured to exert a tensile force and/or compressive force onto the cutting blade (13) to deform the cutting blade (13).

10. An apparatus in accordance with claim 9,
wherein
the adjustment member (50) includes an element (55) displaceable at the blade holder (15) and in communication with the cutting blade (13) via a coupling device (57).

11. An apparatus in accordance with claim 10,
wherein
the coupling device (57) includes at least one articulated lever arranged distributed in the peripheral direction at the displaceable element (55).

12. An apparatus in accordance with claim 1,
wherein
a control device is provided which is configured to actuate the adjustment device (50) as required for carrying out at least one additional function during a cutting operation.

13. An apparatus in accordance with claim 1,
wherein
the blade holder (15) is a component of a blade head (23) which is in fixed position viewed in the adjustment direction (V).

14. An apparatus in accordance with claim 1,
wherein
a blade head (23) is configured as a scythe-like blade head for a scythe-like blade (13) rotating about the blade axis (A).

15. An apparatus in accordance claim 1,
wherein
a blade head (23) is configured as a circular blade head for a circular blade rotating about the blade axis and revolving about the center axis in the manner of a planet.

16. An apparatus in accordance with claim 1,
wherein
at least one rotary drive is associated with a blade head (23).

17. An apparatus in accordance with claim 16,
wherein
the rotary drive is arranged together with the blade head (23) at or in a cutting head housing fixed to the rack.

18. An apparatus in accordance with claim 1,
wherein
the cutting blade (13) is deformable for carrying out blank cuts and/or for setting a cutting gap.

* * * * *

UNITED STATES PATENT AND TRADEMARK OFFICE

CERTIFICATE OF CORRECTION

PATENT NO. : 8,707,840 B2
APPLICATION NO. : 13/079095
DATED : April 29, 2014
INVENTOR(S) : Günther Weber It is certified that error appears in the above-identified patent and that said Letters Patent is hereby corrected as shown below:

| | |
|---|---|
| On the Title Page, Column 1, | |
| Item (75) Inventor, Line 1 | Delete "Gürther" and insert --Günther-- |
| On the Title Page, Column 2, | |
| Item (56) Foreign Patent Documents, Line 10 | Delete "1046479" and insert --1046476-- |
| | |
| In the Specification: | |
| Column 1, Line 21 | Delete "and" and insert --an-- |
| Column 2, Line 46 | After "belt", insert --.-- |
| Column 6, Line 25 | Delete "1" and insert --17-- |
| | |
| In the Claims: | |
| Column 8, Line 58, Claim 2 | Delete "(23)" and insert --(13)-- |
| Column 9, Line 29, Claim 10 | Delete "member" and insert --device-- |

Signed and Sealed this
Twenty-ninth Day of July, 2014

Michelle K. Lee

Michelle K. Lee
*Deputy Director of the United States Patent and Trademark Office*